US005691026A

United States Patent [19]

Zinke et al.

[11] Patent Number: 5,691,026

[45] Date of Patent: Nov. 25, 1997

[54] FASTENER MEMBER WITH A DUAL PURPOSE COVER SHEET

[75] Inventors: Bradley D. Zinke, Woodbury; Timothy N. Narum, Circle Pines, both of Minn.

[73] Assignee: Minnesota Mining and Manufacturing Company, St. Paul, Minn.

[21] Appl. No.: 207,596

[22] Filed: Mar. 8, 1994

Related U.S. Application Data

[63] Continuation-in-part of Ser. No. 97,984, Jul. 27, 1993, abandoned.

[51] Int. Cl.[6] ..... B32B 3/06

[52] U.S. Cl. ..... 428/100; 24/306; 24/442; 24/448; 24/450; 428/86; 428/99; 428/101; 428/352; 428/354; 428/906

[58] Field of Search ..... 428/86, 100, 101, 428/99, 37, 906, 40, 42, 343, 352, 354; 24/306, 442, 448, 450

[56] References Cited

U.S. PATENT DOCUMENTS

| | | | |
|---|---|---|---|
| 2,532,011 | 11/1950 | Dahlquist et al. | 154/53.5 |
| 2,717,437 | 9/1955 | De Mestral | 28/72 |
| 3,005,235 | 11/1961 | Mestral | 28/78 |
| 3,009,235 | 11/1961 | Mestral | 28/78 |
| 3,027,595 | 4/1962 | Takai et al. | 18/10 |
| 3,138,841 | 6/1964 | Naimer | 24/204 |
| 3,147,528 | 9/1964 | Erb | 24/204 |
| 3,192,589 | 7/1965 | Pearson | 24/204 |
| 3,235,438 | 2/1966 | Wisotzky | 161/62 |
| 3,270,408 | 9/1966 | Nealis | 29/408 |
| 3,312,583 | 4/1967 | Rochlis | 161/62 |
| 3,320,649 | 5/1967 | Naimer | 28/72 |
| 3,353,663 | 11/1967 | Kayser et al. | 206/59 |
| 3,408,705 | 11/1968 | Kayser et al. | 24/204 |
| 3,413,678 | 12/1968 | Krantz | 428/100 |
| 3,490,107 | 1/1970 | Brumlik | 24/204 |
| 3,494,006 | 2/1970 | Brumlik | 24/204 |
| 3,522,637 | 8/1970 | Brumlik | 24/204 |
| 3,555,601 | 1/1971 | Price | 18/10 |
| 3,583,057 | 6/1971 | Kolozsvary | 29/270 |
| 3,594,863 | 7/1971 | Erb | 18/5 |
| 3,594,865 | 7/1971 | Erb | 18/5 |
| 3,600,261 | 8/1971 | Kerres | 161/64 |
| 3,660,191 | 5/1972 | Shimota et al. | 156/304.4 |
| 3,708,833 | 1/1973 | Ribich et al. | 24/204 |
| 3,711,349 | 1/1973 | Snyder et al. | 156/157 |
| 3,718,725 | 2/1973 | Hamano | 264/163 |
| 3,762,000 | 10/1973 | Menzin et al. | 24/204 |

(List continued on next page.)

FOREIGN PATENT DOCUMENTS

| | | | |
|---|---|---|---|
| 0 043 714 A1 | 1/1982 | European Pat. Off. . | |
| 0 062 738 | 2/1982 | European Pat. Off. | A47G 27/04 |

(List continued on next page.)

OTHER PUBLICATIONS

Dominick V. Rosato, PE and Donald V. Rosato, PhD (eds), *Injection Molding Handbook*, pp. 504–506, 596, 619–621, 752–754, and 756; Van Nostrand Reinhold Company, New York, 1986.

International Search Report from counterpart foreign application PCT/US94/08013.

*Primary Examiner*—Nasser Ahmad

*Attorney, Agent, or Firm*—Gary L. Griswold; Walter N. Kirn; Charles D. Levine

[57] ABSTRACT

A fastener arrangement includes a first fastener member having a base sheet and a plurality of engaging members projecting from the base sheet. The fastener arrangement includes a layer of pressure sensitive adhesive on a surface of a base sheet opposite of the engaging members, and a dual purpose cover sheet. The dual purpose cover sheet protects the adhesive layer of the first fastener member, and the engaging members of a second, underlying fastener member. The dual purpose cover is releasably attached to the second fastener member by fusing or by using an adhesive having a first non-tacky consistency and a second tacky consistency.

21 Claims, 8 Drawing Sheets

U.S. PATENT DOCUMENTS

| | | | |
|---|---|---|---|
| 3,773,580 | 11/1973 | Provost | 156/66 |
| 3,780,479 | 12/1973 | Billarant et al. | 52/222 |
| 3,817,015 | 6/1974 | Frangos | 428/100 |
| 3,849,840 | 11/1974 | Yamada et al. | 24/204 |
| 3,858,269 | 1/1975 | Sutton et al. | 16/16 |
| 3,863,304 | 2/1975 | Brumlik | 24/204 |
| 3,866,267 | 2/1975 | Poletti | 428/86 |
| 3,913,183 | 10/1975 | Brumlik | 24/204 |
| 4,012,544 | 3/1977 | Richards | 428/100 |
| 4,024,003 | 5/1977 | Bühler | 156/148 |
| 4,041,667 | 8/1977 | Lindner et al. | 52/483 |
| 4,056,593 | 11/1977 | de Navas Albareda . | |
| 4,090,335 | 5/1978 | Curatolo | 52/239 |
| 4,114,346 | 9/1978 | Kelly | 52/746 |
| 4,169,303 | 10/1979 | Lemelson | 24/204 |
| 4,216,257 | 8/1980 | Schams et al. | 428/93 |
| 4,263,755 | 4/1981 | Globus | 51/358 |
| 4,290,174 | 9/1981 | Kalleberg | 24/204 |
| 4,290,832 | 9/1981 | Kalleberg | 156/72 |
| 4,315,885 | 2/1982 | Lemelson | 264/297 |
| 4,322,875 | 4/1982 | Brown et al. | 24/204 |
| 4,336,289 | 6/1982 | Davis | 428/67 |
| 4,350,721 | 9/1982 | Nagase | 428/33 |
| 4,361,610 | 11/1982 | Roth | 428/95 |
| 4,405,668 | 9/1983 | Wald | 428/40 |
| 4,410,327 | 10/1983 | Baggaley | 604/391 |
| 4,437,269 | 3/1984 | Shaw | 51/358 |
| 4,454,183 | 6/1984 | Wollman | 428/92 |
| 4,531,634 | 7/1985 | Jung-Chi | 206/391 |
| 4,536,244 | 8/1985 | Greci et al. | 156/304.4 |
| 4,557,774 | 12/1985 | Hoopengardner | 156/71 |
| 4,563,380 | 1/1986 | Black et al | 428/100 |
| 4,581,269 | 4/1986 | Tilman | 428/62 |
| 4,581,274 | 4/1986 | Johns et al. | 428/95 |
| 4,635,418 | 1/1987 | Hobgood | 52/239 |
| 4,647,484 | 3/1987 | Higgins | 428/40 |
| 4,653,582 | 3/1987 | Ehrenfried | 24/442 |
| 4,665,909 | 5/1987 | Trainor | 128/155 |
| 4,671,976 | 6/1987 | Vidal | 428/40 |
| 4,673,603 | 6/1987 | Roth | 428/100 |
| 4,699,622 | 10/1987 | Toussant et al. | 604/389 |
| 4,706,914 | 11/1987 | Ground | 248/74.3 |
| 4,707,893 | 11/1987 | Hashizume et al. | 24/446 |
| 4,710,414 | 12/1987 | Northrup et al. | 428/43 |
| 4,716,065 | 12/1987 | McLaughlin | 428/100 |
| 4,755,401 | 7/1988 | Friedrich et al. | 428/100 |
| 4,758,457 | 7/1988 | Altus | 428/82 |
| 4,761,318 | 8/1988 | Ott et al. | 428/85 |
| 4,769,895 | 9/1988 | Parkins | 29/450 |
| 4,775,310 | 10/1988 | Fischer | 425/308 |
| 4,784,890 | 11/1988 | Black | 428/100 |
| 4,810,546 | 3/1989 | McLaughlin | 428/62 |
| 4,814,036 | 3/1989 | Hatch | 156/245 |
| 4,819,309 | 4/1989 | Behymer | 24/576 |
| 4,822,658 | 4/1989 | Pacione | 425/95 |
| 4,824,498 | 4/1989 | Goodwin et al. | 156/71 |
| 4,857,371 | 8/1989 | McClintock | 428/36.5 |
| 4,870,725 | 10/1989 | Dubowik | 24/442 |
| 4,872,243 | 10/1989 | Fischer | 24/442 |
| 4,875,259 | 10/1989 | Appeldorn | 24/576 |
| 4,881,997 | 11/1989 | Hatch | 156/66 |
| 4,894,060 | 1/1990 | Nestegard | 604/391 |
| 4,897,891 | 2/1990 | Kallman et al. | 5/493 |
| 4,909,883 | 3/1990 | Adell | 156/247 |
| 4,910,062 | 3/1990 | Zinke et al. | 428/95 |
| 4,921,742 | 5/1990 | Altus | 428/81 |
| 4,931,343 | 6/1990 | Becker et al. | 428/95 |
| 4,933,224 | 6/1990 | Hatch | 428/100 |
| 4,959,265 | 9/1990 | Wood et al. | 428/343 |
| 4,974,384 | 12/1990 | Pacione | 52/483 |
| 5,032,122 | 7/1991 | Noel et al. | 604/391 |
| 5,040,275 | 8/1991 | Eckhardt et al. | 24/447 |
| 5,042,221 | 8/1991 | Pacione | 52/749 |
| 5,056,933 | 10/1991 | Kamp | 383/63 |
| 5,058,247 | 10/1991 | Thomas et al. | 24/448 |
| 5,060,443 | 10/1991 | Pacione | 52/506 |
| 5,066,444 | 11/1991 | Behr | 264/171 |
| 5,067,210 | 11/1991 | Kayaki | 24/452 |
| 5,067,822 | 11/1991 | Wirth et al. | 383/61 |
| 5,077,870 | 1/1992 | Melbye et al. | 24/452 |
| 5,088,164 | 2/1992 | Wilson et al. | 24/576 |
| 5,100,400 | 3/1992 | Mody et al. | 604/391 |
| 5,110,649 | 5/1992 | Morse et al. | 428/100 |
| 5,116,563 | 5/1992 | Thomas et al. | 264/167 |
| 5,133,166 | 7/1992 | Pacione | 52/483 |
| 5,135,909 | 8/1992 | Stephens et al. | 507/121 |
| 5,138,750 | 8/1992 | Gundlach et al. | 24/587 |
| 5,144,786 | 9/1992 | Pacione | 52/747 |
| 5,149,573 | 9/1992 | Kobe et al. | 428/93 |
| 5,180,618 | 1/1993 | Kessler et al. | 428/100 |
| 5,181,461 | 1/1993 | Viaud | 100/88 |
| 5,191,692 | 3/1993 | Pacione | 29/423 |
| 5,196,266 | 3/1993 | Lu et al. | 428/355 |
| 5,201,101 | 4/1993 | Rouser et al. | 24/575 |
| 5,204,155 | 4/1993 | Bell et al. | 428/95 |
| 5,230,851 | 7/1993 | Thomas | 264/145 |
| 5,242,646 | 9/1993 | Torigoe et al. | 264/219 |
| 5,286,431 | 2/1994 | Banfield et al. | 264/134 |
| 5,318,741 | 6/1994 | Thomas | 264/519 |
| 5,354,591 | 10/1994 | Ott et al. | 428/99 |
| 5,382,462 | 1/1995 | Pacione | 428/95 |

FOREIGN PATENT DOCUMENTS

| | | | |
|---|---|---|---|
| 0 093 008 A2 | 11/1983 | European Pat. Off. . | |
| 0 109 941 A1 | 5/1984 | European Pat. Off. . | |
| 0 211 564 A3 | 2/1987 | European Pat. Off. . | |
| 0 288 393 | 4/1988 | European Pat. Off. | E04B 2/86 |
| 0 270 888 A2 | 6/1988 | European Pat. Off. . | |
| 0 276 970 A2 | 8/1988 | European Pat. Off. . | |
| 0 278 866 A1 | 8/1988 | European Pat. Off. . | |
| 0 319 249 A1 | 6/1989 | European Pat. Off. . | |
| 0 325 528 A1 | 7/1989 | European Pat. Off. . | |
| 1383501 | 11/1964 | France . | |
| 1513722 | 1/1968 | France . | |
| 2101195 | 3/1972 | France . | |
| 2149959 | 3/1973 | France . | |
| 2150196 | 3/1973 | France . | |
| 2220216 | 10/1974 | France . | |
| 2364004 | 9/1976 | France . | |
| 2 328 432 | 5/1977 | France . | |
| 2 352 524 | 12/1977 | France . | |
| 2 368 587 | 5/1978 | France . | |
| 2 377 498 | 8/1978 | France . | |
| 7029524 | 11/1970 | Germany . | |
| 2 201 231 | 7/1973 | Germany . | |
| 25 53 979 B2 | 6/1976 | Germany . | |
| 26 47 113 | 5/1977 | Germany | A47G 27/02 |
| 28 03 006 A1 | 8/1979 | Germany . | |
| 32 44 410 A1 | 10/1983 | Germany . | |
| 48-88732 | 11/1973 | Japan . | |
| 49-34519 | 3/1974 | Japan . | |
| 50-127222 | 10/1975 | Japan . | |
| 51-18129 | 2/1976 | Japan . | |
| 51-43827 | 4/1976 | Japan . | |
| 52-56725 | 5/1977 | Japan . | |
| 52-139229 | 11/1977 | Japan . | |
| 53-62332 | 6/1978 | Japan . | |
| 53-74719 | 7/1978 | Japan . | |
| 53-74720 | 7/1978 | Japan . | |
| 54-10525 | 1/1979 | Japan . | |
| 54-3341 | 1/1979 | Japan . | |
| 54-136725 | 10/1979 | Japan . | |

| | | | |
|---|---|---|---|
| 54-149228 | 11/1979 | Japan . | |
| 55-81618 | 6/1980 | Japan . | |
| 55-99223 | 7/1980 | Japan . | |
| 55-136303 | 10/1980 | Japan . | |
| 56-18817 | 2/1981 | Japan . | |
| 56-60514 | 5/1981 | Japan . | |
| 56-70723 | 6/1981 | Japan . | |
| 57-20280 | 2/1982 | Japan . | |
| 57-64016 | 4/1982 | Japan . | |
| 57-122815 | 7/1982 | Japan . | |
| 58-54914 | 4/1983 | Japan . | |
| 58-58019 | 4/1983 | Japan . | |
| 58-149712 | 9/1983 | Japan . | |
| 59-15156 | 1/1984 | Japan . | |
| 59-44216 | 3/1984 | Japan . | |
| 59-108576 | 6/1984 | Japan . | |
| 59-137180 | 9/1984 | Japan . | |
| 60-106410 | 6/1985 | Japan . | |
| 60-132575 | 7/1985 | Japan . | |
| 60-156417 | 8/1985 | Japan . | |
| 60-175603 | 9/1985 | Japan . | |
| 61-68012 | 4/1986 | Japan . | |
| 61-168307 | 7/1986 | Japan . | |
| 61-215766 | 9/1986 | Japan . | |
| 61-255607 | 11/1986 | Japan . | |
| 63-107241 | 7/1988 | Japan . | |
| 339155 | 8/1959 | Switzerland . | |
| 527 594 | 10/1972 | Switzerland . | |
| 1199940 | 7/1970 | United Kingdom . | |
| 1 204 886 | 9/1970 | United Kingdom . | |
| 1205267 | 9/1970 | United Kingdom . | |
| 1 341 817 | 12/1973 | United Kingdom . | |
| 1 376 262 | 12/1974 | United Kingdom . | |
| 1 472 729 | 5/1977 | United Kingdom | A47G 27/00 |
| 1 546 901 | 5/1979 | United Kingdom | A47G 27/00 |
| 1 573 492 | 8/1980 | United Kingdom . | |
| 2 111 106 | 6/1983 | United Kingdom . | |
| 2 142 842 | 1/1985 | United Kingdom . | |
| WO 86/01247 | 2/1986 | WIPO . | |
| WO 86/03164 | 6/1986 | WIPO . | |
| WO 87/06522 | 5/1987 | WIPO . | |
| WO 92/01401 | 2/1992 | WIPO . | |
| WO 93/03644 | 3/1993 | WIPO . | |
| WO 94/23609 | 10/1994 | WIPO | A44B 18/00 |
| WO 94/23610 | 10/1994 | WIPO | A44B 18/00 |

FASTENER MEMBER WITH A DUAL PURPOSE COVER SHEET

CROSS-REFERENCE TO RELATED APPLICATIONS

This is a continuation-in-part application of Ser. No. 08/097,984 filed Jul. 27, 1993, now abandoned.

TECHNICAL FIELD

The present invention relates to a fastener arrangement having a dual purpose cover sheet.

BACKGROUND OF THE INVENTION

Interengaging and intermeshing fastener members are useful in a variety of fields for fastening two objects together. For example, hook and loop fasteners typically include a first fastener member having a base sheet and a plurality of hook members projecting therefrom, and a second fastener member having a base sheet and a plurality of loop members projecting therefrom. When engaged, the hook members catch the loop members to secure the two fastener members together. For purposes of the present invention, a fastener consists of two fastener members, which may or may not be identical. For example, a hook and loop fastener includes a hook fastener member and a loop fastener member.

Exemplary of other fasteners of a similar type are those shown in U.S. Pat. Nos. 3,009,235, 4,454,183, 4,761,318, 4,775,310, 4,894,060, and 5,058,247, which generally disclose a first fastener member having a base sheet and a plurality of headed stems, and a second fastener member having a base sheet and a plurality of loop members. The respective fastener members are secured together in much the same way as hook and loop fasteners, whereby the headed stems engage or catch the loop members to interengage the two fastener members.

Fasteners of the type described above are often most useful when each fastener member is attached to a surface of an object, so that the two objects may be joined together by engaging the respective fastener members. Examples of such applications include fasteners for securing two portions of an article of clothing together, or for securing a piece of trim to a surface. One popular method of attaching the respective fastener members to a surface is to provide a layer of pressure sensitive adhesive on the base sheet, such that the fastener member may be adhered to the surface of the object by the pressure sensitive adhesive. FIG. 1 illustrates such a conventional construction.

As shown in FIG. 1, a fastener member 10 includes a base sheet 12 and a plurality of engaging members 14 (in the form of hooks) that project from the base sheet. Disposed on an opposite major surface of the base sheet 12 is a layer of pressure sensitive adhesive 16, which typically includes a release liner 18 to protect adhesive layer 16 prior to application of the fastener member 10 to a surface. To apply the fastener member 10 to a surface of an object, release liner 18 may be peeled away from the base sheet to expose the adhesive layer 16.

A cover sheet is also provided to prevent the engaging members from contacting and engaging with a surface unintentionally. For example, hook members have a tendency to engage with fabrics and textile materials, and thus a fastener member including hook members may unintentionally become attached to clothing or other fabric prior to use, which is undesirable. A cover sheet 20, shown in FIG. 1, covers the engaging members 14 and thus aids in preventing unintentional engagement of the engaging members with a surface prior to use. Thus, both the cover sheet 20 and the release liner 18 must be removed before the fastener member may be used.

A fastener of the foregoing construction has been used in the field of carpet application. Specifically, a fastener member may be used to anchor carpet to a floor near a wall, or along a seam between adjacent sections of carpet. Loop-like textile structures are provided on the back of the carpet, and engaging members are provided on the fastener member to engage the loop-like structures and affix the carpet to the floor.

An example of a fastener used in conjunction with carpet is shown in FIGS. 2A through 2D. Fastener member 10 may be applied to a surface, such as a floor 30, by removing the release liner 18 and pressing the adhesive layer 16 into contact with the floor. Cover sheet 20 is typically left attached to the engaging members 14 while the carpet is being positioned and cut to size. Cover sheet 20 thus prevents unintentional engagement between the fastener member and the carpet while the carpet is being manipulated in the vicinity of the fastener member. Furthermore, the engaging members are protected from contamination or damage due to exposure to people, dust, paint, fabrics, and the like. When the carpet 32 has been cut and fit into place, cover sheet 20 may be peeled away from fastener 10, allowing loop structures 34 of carpet 32 to engage the engaging members 14. Such a fastening arrangement, in addition to affixing the carpet to the floor, also allows the carpet to be peeled away from the fastener member for cleaning or replacement. Although the fastener product described above is widely used, it would be desirable to reduce material costs inherent in the product. Furthermore, because both the release liner and the cover strip must both be removed prior to the application of the fastener member, the application process can be relatively time consuming, and therefore expensive. It is also desirable to reduce waste associated with all products that are used by consumers. In view of these concerns, it is desirable to provide an inexpensive fastener member that is useful for applications such as those described above.

SUMMARY OF THE INVENTION

A fastener arrangement is disclosed, comprising a first fastener member, including a base sheet having a first major surface, and a plurality of engaging members attached to and projecting from the first major surface. The fastener arrangement also includes a dual purpose cover sheet having first and second major surfaces, the first major surface including means for releasable affixation to the first fastener member, and a second fastener member overlying the first fastener member. The second fastener member includes a base sheet having first and second major surfaces, a multiplicity of engaging members attached to and projecting from the first major surface, and an adhesive layer disposed on the second major surface of said base sheet. The adhesive layer releasably affixes the second fastener member to the second major surface of said cover sheet.

Also provided is a method of providing a fastener arrangement. The method comprises the steps of providing a first fastener member, including a base sheet having first and second major surfaces, and a plurality of engaging members attached to and projecting from the first major surface; providing a dual purpose cover sheet having first and second major surfaces; releasably affixing the first major surface of the cover sheet to the first fastener member; providing a second fastener member including a base sheet having first and second major surfaces, a plurality of engaging members attached to and projecting from the first major surface, and an adhesive layer disposed on the second major surface; and releasably affixing the adhesive layer of the second fastener member to the second major surface of the cover sheet.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

The present invention relates broadly to a fastener member having a dual purpose cover sheet. The dual purpose cover sheet functions both to be releasably affixed to the engaging members and/or base sheet of a first fastener member, and to be releasably affixed to a pressure sensitive adhesive layer of a second, overlying fastener member. Thus, the single cover sheet of the present invention replaces the cover sheet and release liner of the prior art, with a concomitant savings in time, cost, and waste.

Figure 1:
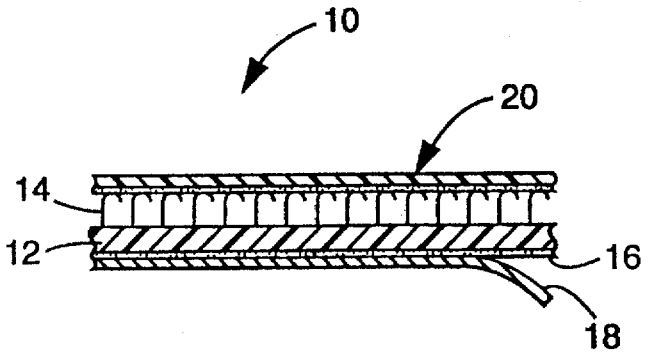
Fig. 1 PRIOR ART
FIG. 1 is a sectional view of a fastener member having a cover sheet and a release liner according to the prior art.
Figure 2A:
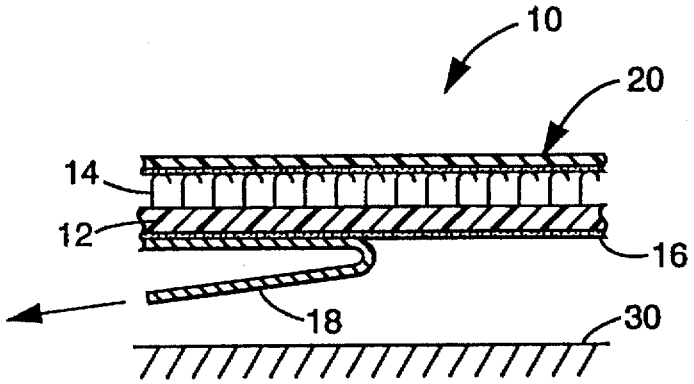
Fig. 2A PRIOR ART
FIGS. 2A through 2D are sectional views of sequential steps in the process of applying a conventional fastener member to a surface.
Figure 2B:
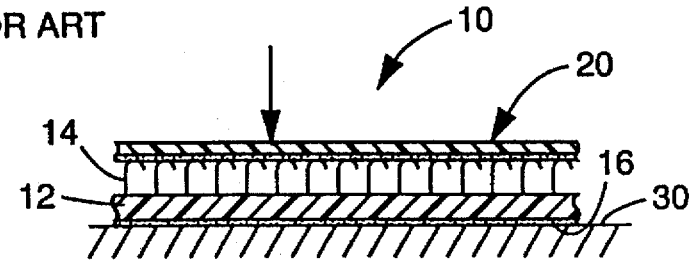
Fig. 2B PRIOR ART
Figure 2C:
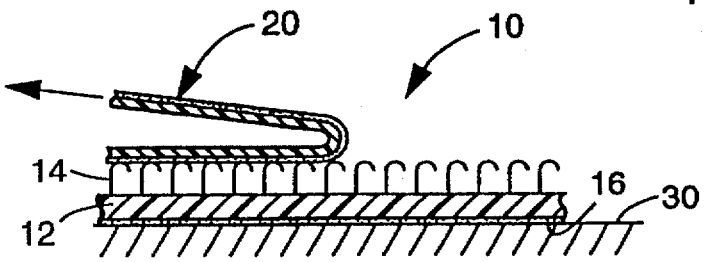
Fig. 2C PRIOR ART
Figure 2D:
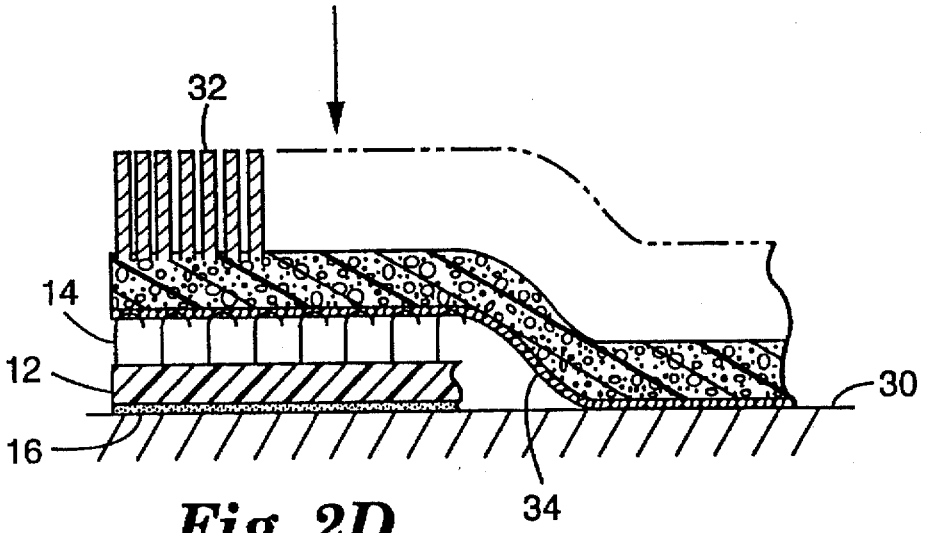
Fig. 2D PRIOR ART
Figure 3:
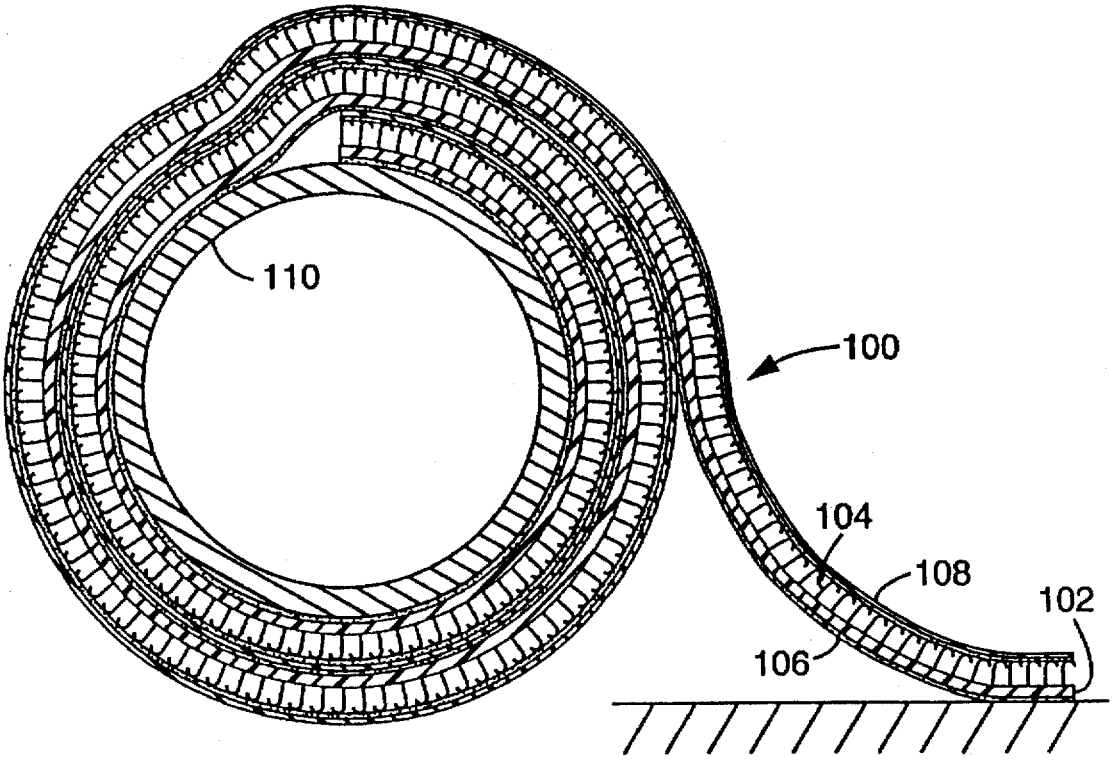
FIG. 3 is a sectional view of a fastener arrangement including a fastener member having a dual purpose cover sheet according to the present invention.

A preferred embodiment of the invention is illustrated in FIG. 3. Fastener member 100 is provided, including a base sheet 102, a plurality of engaging members 104, a layer of pressure sensitive adhesive 106, and a dual purpose cover sheet 108. Each of the various components will be described individually, followed by a description of the overall structure, method of construction, and operation of the present invention. The numeric ranges for various values provided herein are intended only to be illustrative, rather than limiting, of the present invention.

Base Sheet: The base sheet may be made from any suitable material and in any suitable size. For example, the base sheet may be made of polymer (e.g. polyethylene, polypropylene, polyester, nylon, or rubber), textile materials (e.g. cotton), or metal. The base sheet may be extruded, woven, knitted, stitched, or made of a nonwoven or other material, and may be made of two or more of these and other materials (e.g. a laminate, or a blend). The thickness of such a base sheet is preferably between 0.127 and 3.810 turn (0.005 and 0.150 in). The width of the base sheet may be selected as desired, and widths in the range of 0.635 to 365 cm (0.250 to 144 in) can be used.

Figure 8:
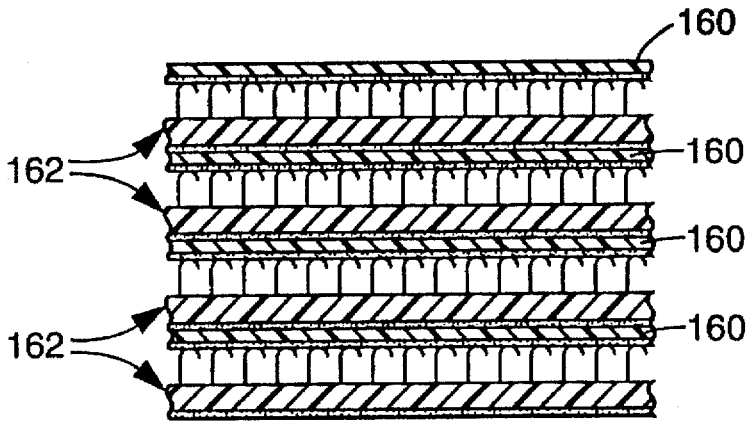
FIG. 8 is a sectional view of an alternate fastener arrangement according to the present invention.

The dimensions and material for the base sheet are preferably selected so that the base sheet is flexible, to facilitate attachment of the fastener member to uneven surfaces. Furthermore, a fastener member having a flexible base sheet may be coiled around a core 110 to form a roll. However, rigid base sheets may also have applicability in the context of the invention in, for example, a stack of individual fastener members, as shown in FIG. 8.

The base sheet performs at least two functions. First, the base sheet must hold the engaging members in place, so that the engaging members are not detached from the base sheet when the attached fastener members are separated from each other. Second, the base sheet must provide a surface for receipt of the layer of pressure sensitive adhesive. This surface may be smooth, striated, hurled, wavy or of any other suitable topographical design.

Engaging Members: The engaging members of the present invention may be one or more of many different types of such members. For example, the engaging members may comprise hook portions, loop portions, structured surfaces, headed stems, woven or nonwoven fibers, or any other suitable structures. Hook portions and loop portions such as those disclosed in U.S. Pat. Nos. 3,009,235, 4,761,318, 4,775,310, 4,894,060, and 5,067,210, the contents of each of which is hereby incorporated by reference, may have utility in this regard. Similarly, structured surfaces such as those disclosed in U.S. Pat. Nos. 4,875,259, 5,088,164, and 5,196,266, the contents of each of which is hereby incorporated by reference, are exemplary, and may be useful in the context of the present invention. Headed stems are disclosed in patents such as U.S. Pat. Nos. 3,138,841, 4,290,174, and 4,454,183, the contents of each of which is hereby incorporated by reference, and also may have utility in conjunction with the present invention. Other suitable engaging members are also contemplated.

The various engaging members are attached to, bonded to, or formed from the base sheet, and should be suitable for engaging an opposed fastener member, as described previously. The opposed fastener may be identical to or different from the subject fastener member, depending on the relative configurations and performance characteristics of each.

Adhesive Layer: The adhesive layer is disposed on the major surface of the base sheet opposite the engaging members. Adhesives that may be useful as the adhesive layer in the present invention include pressure sensitive and non-pressure sensitive adhesives. The former class of adhesives are preferred, and are normally tacky at room temperature, and can be adhered to a surface by the application of light finger pressure. The latter class of adhesives include those that are solvent, heat, or radiation activated. The adhesives may be based on, for example, general compositions of polyacrylate, polyvinyl ether, rubber (e.g. natural rubber), isoprene, polychloroprene, butyl rubber, polyisobutylene, butadiene-acrylonitrile polymer, thermoplastic elastomer, styrene-butadiene polymer, polyalphaolefin, amorphous polyolefin, silicone, ethylene-containing copolymer (e.g. ethylene vinyl acetate, ethylene ethyl acrylate, ethylene n-butyl acrylate, and ethylene methyl acrylate), polyurethane, polyamide, epoxy, polyvinylpyrrolidone and polyvinylpyrrolidone copolymers, polyesters, and mixtures or copolymers of the foregoing. The adhesive layer may also contain, for example, tackfliers, plasticizers, fillers, antioxidants, stabilizers, pigments, curatives, crosslinkers, solvents, and the like.

The thickness of the layer of pressure sensitive adhesive may be selected as desired. Thicknesses in the range of 0.0025 to 0.102 cm (0.001 to 0.040 in) have been shown to have utility in the context of the present invention, although other adhesive layer thicknesses may also be used for certain applications. The adhesive layer may be applied to the base sheet as known in the art. For example, the adhesive may be applied to the base sheet by solvent coating, extrusion (either separately from or simultaneously with the base sheet), hot melt coating, calendaring, curtain coating, gravure or pattern coating, spray coating, lamination, pressure feed die coating, knife coating, or by any other suitable technique. It is expressly contemplated that the adhesive layer can be either continuous (such as a uniform layer) or discontinuous (such as strips or bands, dots, or another patterned or random arrangement of discrete adhesive portions).

Although a single layer of adhesive is preferred, one or more additional layers may also be provided. These additional layers may be provided between the adhesive layer and the base sheet (e.g. a primer layer to facilitate bonding between the adhesive layer and the base sheet), or may be applied over the adhesive layer (e.g. an antistatic layer, a low adhesion backsize (LAB), or a detackifying agent), or both. Of course, multiple layers of adhesive are also contemplated.

The particular characteristics of the adhesive layer may be selected to provide appropriate adhesion and release characteristics. In carpet applications, for instance, it may be desirable to provide an adhesive layer that is highly resistant to removal from the surface to which the fastener member is attached. The characteristics of various adhesives are well known, and thus a suitable adhesive may be selected for a particular application.

Dual Purpose Cover Sheet: The dual purpose cover sheet is preferably made of a thin, flexible material having two opposed major surfaces. The first major surface should be suitable for releasable affixation to the engaging members and/or to the base sheet, and the second major surface should be suitable for releasable affixation to the pressure sensitive adhesive layer.

The first major surface of the dual purpose cover sheet may comprise any suitable material that may be releasably affixed to the engaging members and/or to the base sheet. For example, if the engaging members comprise hook structures, the first major surface may include a plurality of loop structures for engagement with the hook structures. As another example, the first major surface may comprise a pressure sensitive adhesive to enable adhesive affixation between the cover sheet and the engaging members. Another alternative is to apply on the first major surface an adhesive, such as a polymer having a low melting point or a hot melt adhesive adapted for transition from a first non-tacky state at room temperature to a second tacky state when heated, and then to heat the cover sheet until the adhesive becomes tacky. The warm and tacky adhesive is then applied to the engaging members and/or to the base sheet where it then cools and again becomes non-tacky. An advantage of using an adhesive which is not tacky at room temperature is that it permits more efficient handling of the cover sheet during the prefabrication stages of the fastener member when the cover sheet is applied to the engaging members and/or base sheet and also during the application of the fastener arrangement when the cover sheet is removed from the engaging members and/or base sheet. Only when the cover sheet is ready to be applied to the engaging members and/or to the base sheet during the prefabrication stage is the non-tacky adhesive heated to the point where it tacky. The adhesive shown in FIG. 8 is continuous on the cover sheet and may be either tacky or non-tacky at room temperature.

Figure 10:
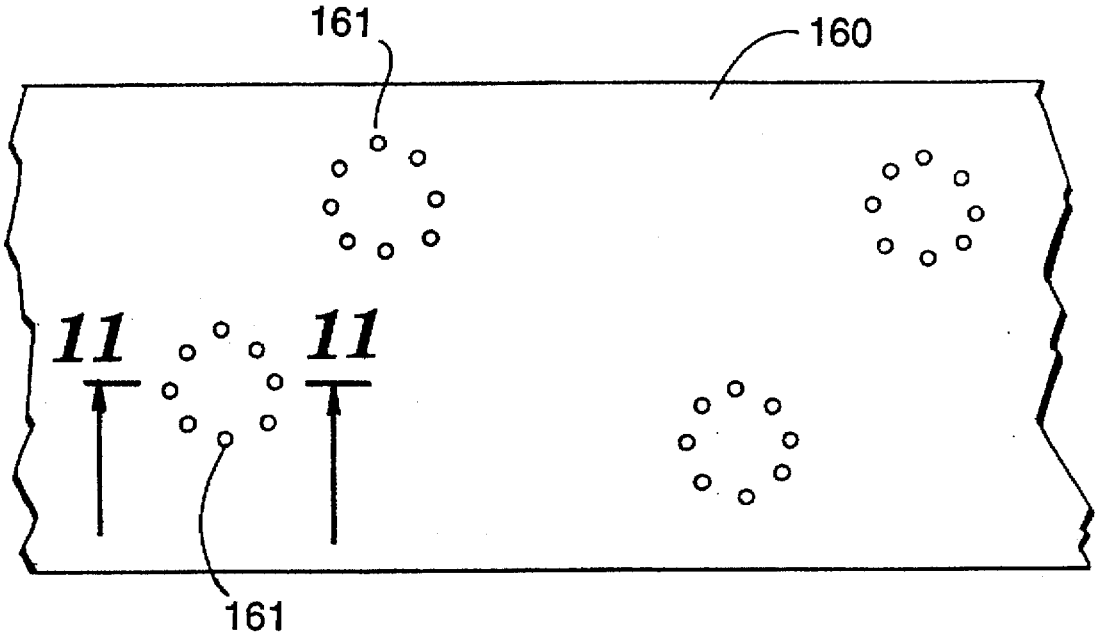
FIG. 10 is a top plan view of an another alternative embodiment of the fastener member and dual purpose cover sheet according to the present invention.

A further alternative is to affix the cover sheet directly to the engaging members and/or to the base sheet by fusing or bonding. As shown at 161 in FIGS. 10 and 11 and as further explained in Example Six ultrasonic bonding is one method of attaching the cover sheet to the engaging member or as shown at 161' in FIG. 15 to the base sheet. Other methods which utilize heat to melt or fuse the cover sheet to the engaging members include dielectric bonding, radio frequency bonding and heat bonding. Ultrasonic bonding uses high frequency sound waves which, when directed into the cover sheet and engaging members and/or base sheet, generate heat by causing ultrasonic vibrations in the materials and thereby fuse or melt the cover sheet and engaging members and/or base coat to each other. Ultrasonic bonding works best when the cover sheet and engaging members are constructed of similar materials. Ultrasonic bonding has the advantage of eliminating an otherwise necessary adhesive thereby saving material costs.

Figure 12:
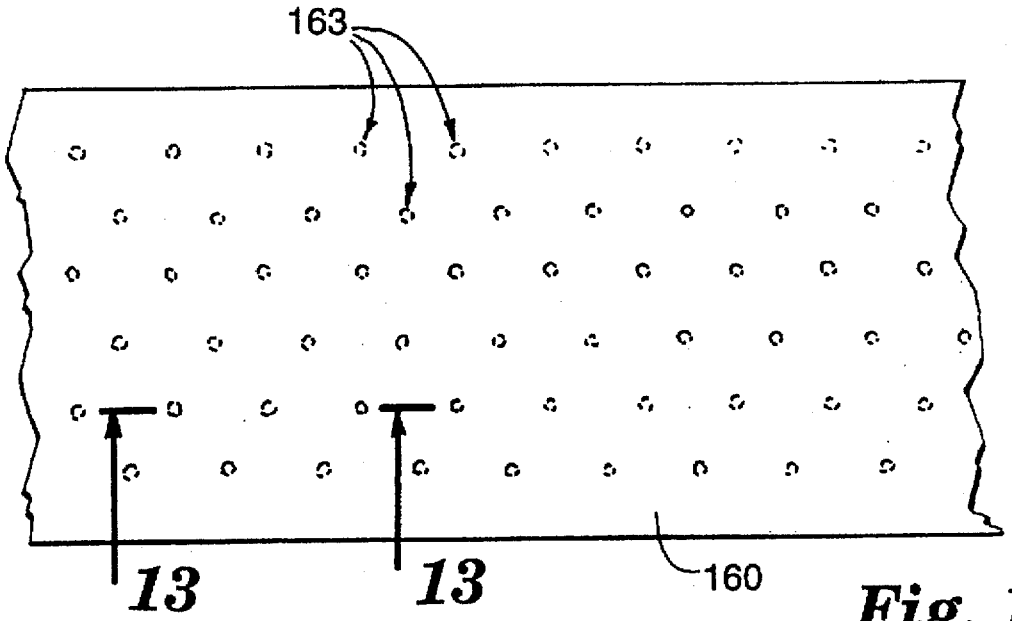
FIG. 12 is a top plan view of a further alternative embodiment of the fastener member and dual purpose cover sheet according to the present invention.
Figure 13:
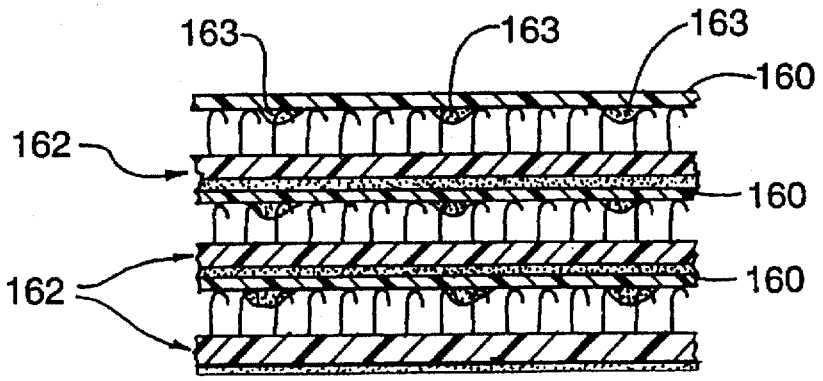
FIG. 13 is a partial sectional view taken across line 13—13 in FIG. 12.

The means for releasably affixing the cover sheet to the engaging members may be continuous (a uniform arrangement of loop members or uniform adhesive layer, for example) or discontinuous (narrow bands or dots of adhesive, discrete sections of loop members, ultrasonic weld or bond patterns, for example). FIGS. 12 and 13 illustrate a fastener member in which the cover sheet has an adhesive dot coating 163 for affixation to the engaging members as will be further explained in Example Seven. If an adhesive is used to releasably engage the cover sheet to the engaging member, then it is preferable, for the reasons mentioned above, to use an adhesive which is not tacky at room temperature but which becomes tacky after heating.

Figure 14:
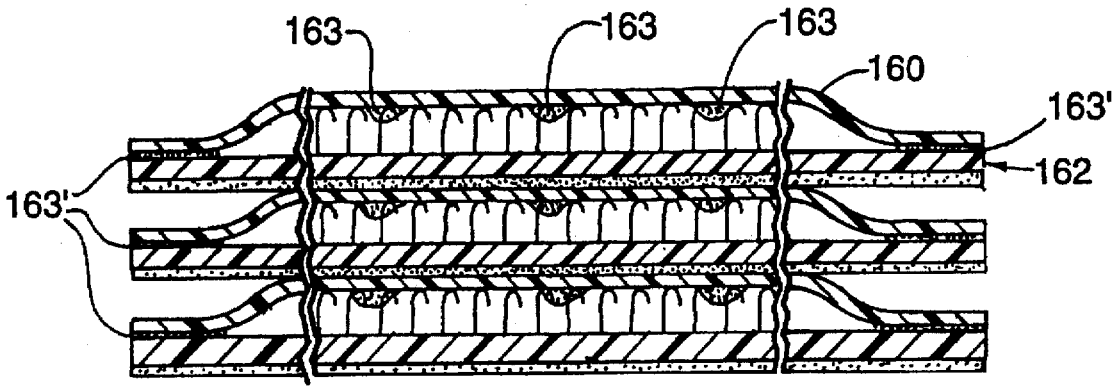
FIG. 14 is a sectional view of another alternative embodiment of the fastener member and dual purpose cover sheet according to the present invention.

FIG. 14 illustrates an embodiment of the fastener arrangement in which the cover sheet is attached to the lateral edges of the base sheet and also to the engaging members using an adhesive such as a polymer having a low melting point or hot melt adhesive which has a first non-tacky consistency at room temperature and a second tacky consistency when heated. In this embodiment no engaging members are provided at the lateral edges of the base sheet 162 to permit the releasable affixation of the cover sheet thereto.

Figure 15:
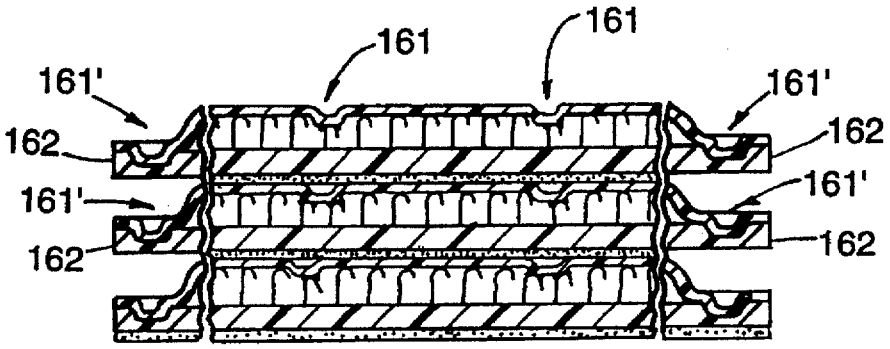
FIG. 15 is a sectional view of a further alternative embodiment of the fastener member and dual purpose cover sheet according to the present invention.

FIG. 15, as mentioned above, illustrates an embodiment of the fastener arrangement in which the cover sheet is attached to the lateral edges of the base sheet and also to the engaging members using a series of ultrasonic bonds along the lateral edges of the base sheet. As with the embodiment in FIG. 14, no engaging members are provided at the lateral edges of the base sheet 162 to permit releasable affixation of the cover sheet thereto.

Figure 16:
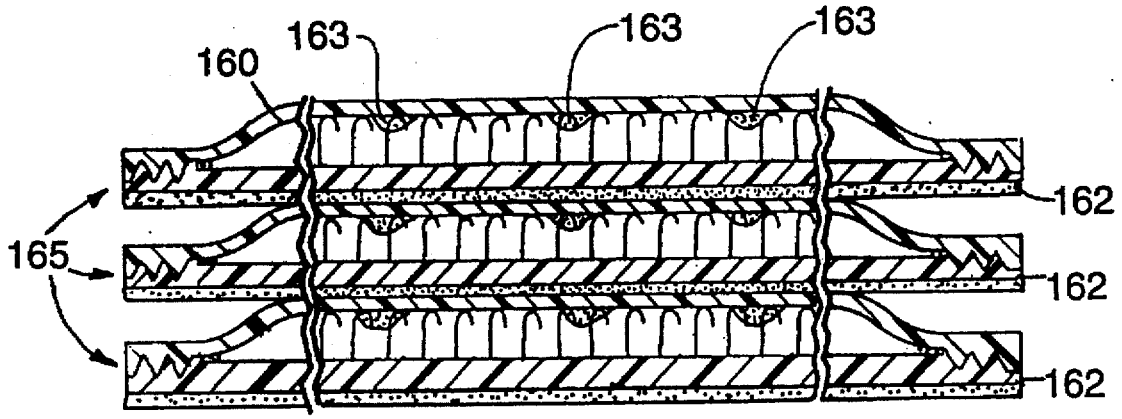
FIG. 16 is a sectional view of an additional alternative embodiment of the fastener member and dual purpose cover sheet according to the present invention.

FIG. 16 illustrates an embodiment of the fastener arrangement in which the lateral edges of the cover sheet is attached to the lateral edges of the base sheet using a mechanical interlock of the type described in U.S Pat. No. 5,088,164, which includes a pair of intermeshable closure members. Other mechanical interlock mechanisms which may used include, for example, those described in U.S. Pat. Nos. 5,138,750; 5,135,909; 5,056,933; 5,067,822; 5,066,444; and U.S. Pat. No. 5,181,461 which are hereby incorporated by reference.

Although FIGS. 14–16 illustrate the cover sheet attached directly to a top surface of the base sheet and/or to the engaging members it is within the intended scope of the present invention that the cover sheet may be attached to any selected portion of the base sheet and/or engaging members. For example, the cover sheet may be releasably attached to the side edges of the base sheet or it may be wrapped around the side edges and releasably attached to the major surface of the cover sheet opposite the engaging members.

The second major surface of the dual purpose cover sheet is adapted for releasable engagement with the pressure sensitive layer described above. The second major surface may comprise, for example, a release coating such as silicone, an LAB coating (such as that described in U.S. Pat. No. 2,532,011 (Dahlquist et at.)), a plasma coating, a Teflon™ coating, a structured surface, a low energy polymeric surface such as polyethylene, fluorocarbon additives, or no coating or structure at all. Again, these and other release features of the second major surface are preferably continuous over the area of the surface.

The dimensions of the dual purpose cover sheet may be selected to suit the particular application. It is preferred that the dual purpose cover sheet be approximately 0.012 to 1.78 mm (0.0005 to 0.070 in) thick, and that the cover sheet be at least as wide as the wider of the pressure sensitive adhesive layer and the plurality of engaging members. For carpet fastening applications, the dual purpose cover sheet is preferably thin, flexible, and tear resistant, so that the cover sheet may be withdrawn through a thin seam between sections of carpet, or along a wall. Furthermore, the adhesion between the cover sheet and the engaging members should be sufficient to insure that the cover sheet is not inadvertently peeled away from the fastener.

Suitable materials for the dual purpose cover sheet may include, but are not limited to, treated or untreated paper (e.g. crepe, rope tissue, repulpable tissue, and kraft), woven fabric (e.g. cotton, rayon, polyester, glass, and nylon), polymeric film (e.g. cellophane, acetate, polyester, vinyl, polyvinyl chloride, polypropylene, polyethylene, and polyimide), nonwoven fabric, foil (e.g. aluminum, stainless steel, and lead), foam (e.g. open and closed cell polyethylene, polyvinyl chloride, polyurethane, and polychloroprene), rubber (e.g. neoprene), metallized film, or combinations or laminates of the foregoing. The cover sheet may also include fibers, fillers, plasticizers, pigments, stabilizers, antioxidants, or mixtures thereof. The cover sheet may additionally bear a primer layer, or be surface treated (e.g. corona discharge treated) to promote adhesion of other constituents to it. Alternatively or additionally, the cover sheet may undergo an orientation processing step to improve its tensile strength characteristics, or be coated with an LAB to prevent bonding or transfer of the adhesive. The LAB may be selected to facilitate removal of the fastener member from the dual purpose cover sheet, and may not be necessary for some adhesives. Also, an antistatic agent may be incorporated into the cover sheet, to prevent accumulation of static electricity on the sheet.

It should be noted that in the preferred embodiment, the characteristics of the dual purpose cover sheet are selected so that the cover sheet remains affixed to the engaging members and/or to the lateral edges of the base sheet of the underlying fastener member, rather than to the adhesive layer of the overlying fastener member, when the two fastener members are peeled apart. That is, the cover sheet should preferably release from the pressure sensitive adhesive layer and remain attached to the engaging members and/or the base sheet of the underlying layer of the fastener member. Stated yet another way, the adhesion force between the cover sheet and the layer of pressure sensitive adhesive is preferably less than the affixation force between the cover sheet and the engaging members of an adjacent fastener member. For example, a combination of adhesive and cover sheet may be selected such that the adhesive layer separates from the underlying cover sheet at a force of 24.6 g/cm width (0.138 lb/in width), and the cover sheet separates from the engaging members at a force of 70 g/cm width (0.38 lb/in width). These illustrative disengagement forces were measured on a fastener member of the construction described below in Example One.

The force required to separate the fastener member from the underlying dual purpose cover sheet may also be greater than the force required to separate the cover sheet from the underlying engaging members. In the case of the construction shown in FIG. 3, using a fastener and cover sheet such as that described in Example Five, the force required to separate the fastener member and adhesive layer from the cover sheet was approximately 258 g/cm width (1.44 lbs/in). The force required to separate the cover sheet from the underlying engaging members was approximately 20.9 g/cm width (0.12 lbs/in). However, because the fastener member was wound in a coil, the tensile forces in the cover sheet prevented the cover sheet from being lifted away from the engaging members when the overlying fastener member was peeled from the roll. Thus, the relationship of the two force levels (between fastener member and cover sheet, and between cover sheet and engaging members) may be selected as desired.

Figure 4:
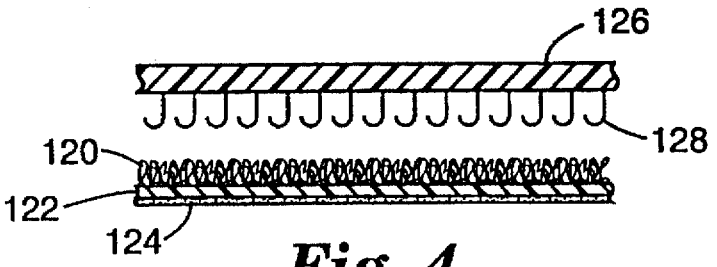
FIGS. 4 through 7 are sectional views of alternate embodiments of the fastener member and dual purpose cover sheet of the present invention.

Various embodiments of the inventive fastener member are illustrated in FIGS. 4 through 7. FIG. 4 shows an embodiment wherein the engaging members comprise a plurality of loop structures 120, which are attached to a base sheet 122 having a layer of pressure sensitive adhesive 124 disposed on the opposite surface. Dual purpose cover sheet 126 includes a plurality of hook structures 128 adapted for releasable interengagement with the loop structures.

Figure 5:
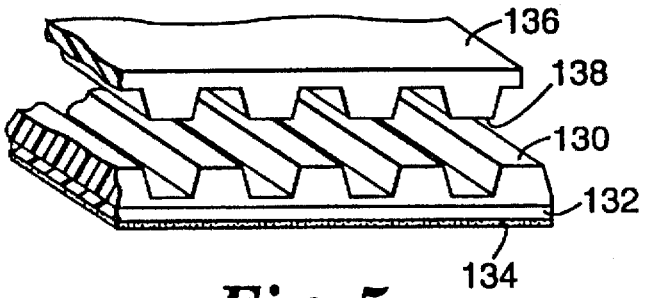

FIG. 5 shows an embodiment wherein the engaging members comprise a structured surface 130, which is attached to a base sheet 132 having a layer of pressure sensitive adhesive 134 disposed on the opposite surface. Although structured surface 130 and base sheet 132 are shown as being discrete components, they could instead be unitary. Dual purpose cover sheet 136 includes an opposed, matching structured surface 138, which is adapted to intermesh with structured surface 130 to secure the cover sheet. The respective structured surfaces may have one of many different patterns, which need not necessarily match each other.

Figure 6:
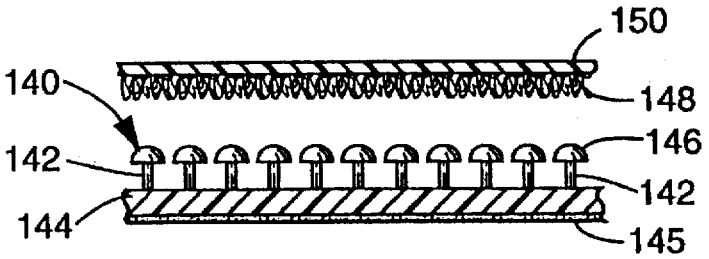
Figure 7:
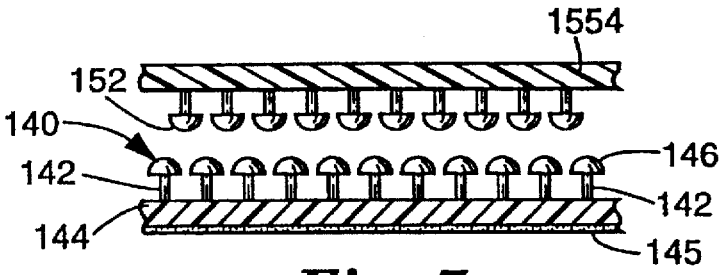

The embodiments shown in FIGS. 6 and 7 include engaging members that are generally shaped as headed stems 140, which each include a stem 142 that projects from base sheet 144, and a head 146 formed at the distal end of stem 142. A layer of pressure sensitive adhesive 145 is provided on the opposite surface of base sheet 144. Heads 146 may be hemispherical, conical, or some other suitable shape, as known in the fastener art. The dual purpose cover sheet may include loop structures 148 anchored to a base sheet 150, as shown in FIG. 6, or mating headed stems 152 anchored to a base sheet 154, as shown in FIG. 7.

The dual purpose cover sheet of the present invention has primary, although not exclusive, applicability to fastener members provided in roll form, as shown in FIG. 3. In the context of the embodiment shown in FIG. 3, a first fastener member and a second fastener member may be spaced portions of a unitary, longitudinally extending fastener member, rather than individual, discrete fastener members. Other fastener arrangements, such as the stack arrangement shown in FIGS. 8 and 10–16, with the dual purpose cover sheet 160 disposed between adjacent fastener members 162, are also included within the scope of the present invention.

The construction and operation of the present invention will be better understood with reference to the following Examples.

EXAMPLE ONE

Figure 9:
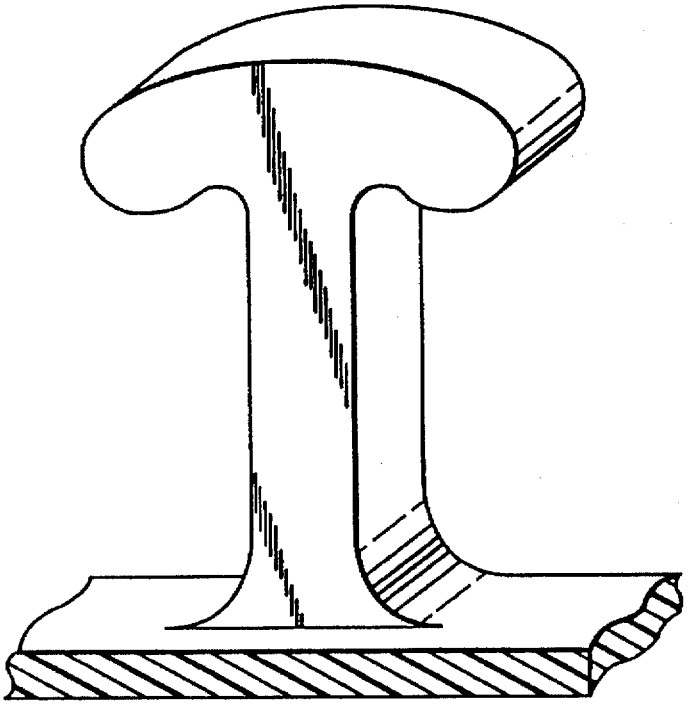
Fig. 9 PRIOR ART
FIG. 9 is a perspective view of an exemplary engaging member for use with the present invention.

A fastener member was produced by the process described in U.S. Pat. No. 4,894,060 (Nestegard). Both the base sheet and the engaging members of the fastener member comprised a polypropylene copolymer resin, available from the Shell Chemical Company of Houston, Tex., under the designation SRD 6-166. The base sheet measured approximately 100 mm (4 in) wide, and 0.18 mm (0.007 in) thick, and included a plurality of T-shaped engaging members that projected from the base sheet. Each T-shaped engaging member, an example of which is shown in FIG. 9, measured approximately 0.254 mm (0.010 in) high, and the engaging members were regularly spaced at a density of approximately 66 per square cm (425 per square inch). A layer of hot melt coated pressure sensitive adhesive approximately 0.254 mm (0.010 in) thick was extruded by a single screw extruder onto the base sheet on the major surface opposite the engaging members, at a temperature of approximately 154.5° C. (310° F.). The hot melt adhesive used was a Kraton™ styrene-butadiene-styrene rubber-based adhesive, comprising the following elements:

| Material | % (by weight) | Available Through |
|---|---|---|
| Kraton ™ 1118 rubber | 19.8% | Shell Chemical Co. (Houston, TX) |
| Solprene ™ 1205 Rubber | 20.8% | Housemex, Inc. (Houston, TX) |
| Piccolyte ™ A135 Resin | 48.3% | Hercules, Inc. (Brunswick, GA) |
| Shellflex ™ 371 Oil | 10.1% | Shell Chemical Co. (Houston, TX) |
| Irganox ™ 1076 Antioxidant | 1.0% | Ciba Giegy Indus. Chem. (McIntosh, TX) |

The adhesive layer was allowed to cool at room temperature. The dual purpose cover sheet was provided, and was applied to the engaging members. The cover sheet was made of cast polypropylene and coated with a rubber based adhesive on one side, for affixation to the engaging members, and a silicone release agent on the other side, to permit releasable engagement with the pressure sensitive adhesive layer. The cover sheet measured approximately 13.7 cm (4.5 in) wide, and 0.178 mm (0.007 in) thick. A cover sheet of this type is available from the Minnesota Mining and Manufacturing Company under the designation KR-0261.

The fastener member was wound on a core having a silicone release agent on the outer cylindrical surface, such that the adhesive layer adhered the fastener member to the core. As the fastener member was wound on the core, the cover sheet received the pressure sensitive layer of the fastener member above it, as shown generally in FIG. 3. To unwind the roll, the fastener member including the cover sheet was peeled from the core and applied to a surface. To secure an object (such as another fastener member, or a piece of carpet, for example) to the fastener member mounted on the surface, the cover sheet was removed to expose the engaging members. The object could then be releasably attached to the engaging members. The foregoing fastener arrangement was found to perform satisfactorily.

EXAMPLE TWO

A fastener member was prepared as described above with reference to Example One, with the following exceptions. The dual purpose cover sheet number KR-0261 was replaced by a dual purpose cover sheet including a base sheet having protruding nylon tricot loop members, available from the Guilford Mills Co. of Greensboro, N.C., under the designation #31835. The opposite (back) surface of the cover sheet was corona treated with a 400 watt corona treatment station (operating at 13.5 amps, 75 volts, and a frequency of 27 kHz) while travelling at 0.25 m/s (50 ft/min). Following the corona treatment step, the back surface of the cover sheet was coated with approximately 0.05 grains of silicone per 15,000 $mm^2$ (2.4 $in^2$), to facilitate release of an overlying adhesive layer. The silicone was available from the Dow Chemical Company of Midland, Mich., under the designations #7850 (97.2% by weight) and #7488 (2.8% by weight). The silicone was cured at approximately 107° C. (225° F.) for 15 seconds.

The cover sheet thus prepared was applied to the fastener member described in Example One, with the loop members of the cover sheet engaging with the engaging members of the fastener member. The fastener member and dual purpose cover sheet were wound on a core in the manner described in Example One, and were aged at room temperature for three weeks. The fastener member was found to perform satisfactorily.

It should be noted that the foregoing construction may not be suitable for all applications, because the cover sheet is highly permeable, which allows air flow past the adhesive layer of the fastener member. This air flow can cause some adhesives to lose tack, as is known in the art. Thus, adhesives used with the foregoing construction should be selected to be resistant to the potentially deleterious effects of air flow.

EXAMPLE THREE

A fastener member was prepared as described above with reference to Example One, with the following exceptions. The KR-0261 dual purpose cover sheet was replaced by a biaxially oriented polypropylene film tape cover sheet. The tape cover sheet was prepared with a pressure sensitive adhesive on one surface, for application to the engaging members, and with an LAB coat on the opposite surface, for application to the pressure sensitive adhesive layer of an overlying fastener member. A tape of such a construction is available from the Minnesota Mining and Manufacturing Company, under the designation Highland™ Brand Utility Box Sealing Tape #371.

The adhesive side of the tape cover sheet was applied to the uppermost portions of the engaging members, and thus the LAB side was presented for receipt of the pressure sensitive adhesive layer of an overlying fastener member. The fastener member and the tape cover sheet were thereafter wound on a core in the manner described in Example One, and was aged for one week at room temperature. The fastener member was difficult to unwind, because of the high adhesion between the pressure sensitive adhesive layer of the fastener member and the LAB side of the tape cover sheet. It is believed that the use of a less aggressive adhesive on the fastener member, or a more effective LAB on the cover sheet, would result in better unwinding performance.

EXAMPLE FOUR

A fastener member was prepared as described above with reference to Example One, with the following exceptions. The KR-0261 dual purpose cover sheet was replaced by a base sheet having loop members, comprising a polypropylene copolymer sheet with polypropylene loop members projecting therefrom. The overall thickness of the cover sheet was 1.65 mm (0.065 in), including a base sheet measuring approximately 0.051 mm (0.002 in) thick and loop members measuring approximately 1.6 mm (0.063 in) high. The density of the loop members was approximately 33 $g/m^2$ (0.062 $lb/yd^2$). A product of this general type is particularly described in PCT Patent Publication No. 92/01401.

The surface of the cover sheet opposite the loop members (the back surface) was corona treated with a 400 watt corona treatment station (operating at 13.5 amps, 75 volts, and a frequency of 27 kHz) while travelling at 0.25 m/s (50 ft/min). Following the corona treatment step, the back surface was coated with approximately 0.022 grains of silicone per 15,000 $mm^2$ (24 in:), to facilitate release of an overlying adhesive layer. The silicone was available from the Dow Chemical Company under the designations #7850 (97.2% by weight) and #7488 (2.8% by weight). The silicone was cured at approximately 107° C. (225° F.) for 15 seconds.

The cover sheet thus prepared was applied to the fastener member described in Example One, with the loop members of the cover sheet engaging with the engaging members of the fastener member. The fastener member and dual purpose cover sheet were wound on a core in the manner described in Example One, and were aged at room temperature for three weeks. The fastener member was found to perform satisfactorily.

EXAMPLE FIVE

A fastener member was prepared as described above with reference to Example One, with the following exceptions. The KR-0261 dual purpose cover sheet was replaced by a biaxially oriented polyester film tape cover sheet. The tape cover sheet was prepared with a pressure sensitive adhesive on one surface, for application to the engaging members, and with an LAB coat on the opposite surface, for application to the pressure sensitive adhesive layer of an overlying fastener member. A tape of such a construction is available from the Minnesota Mining and Manufacturing Company, under the designation #353.

The adhesive side of the tape cover sheet was applied to the uppermost portions of the engaging members, and thus the LAB side was presented for receipt of the pressure sensitive adhesive layer of an overlying fastener member. The fastener member and the tape cover sheet were thereafter wound on a core in the manner described in Example One, and was aged for one week at room temperature. The fastener member was difficult to unwind, because of the high adhesion between the pressure sensitive adhesive layer of the fastener member and the LAB side of the tape cover sheet. It is believed that the use of a less aggressive adhesive on the fastener member, or a more effective LAB on the cover sheet, would result in better unwinding performance.

EXAMPLE SIX

Figure 11:
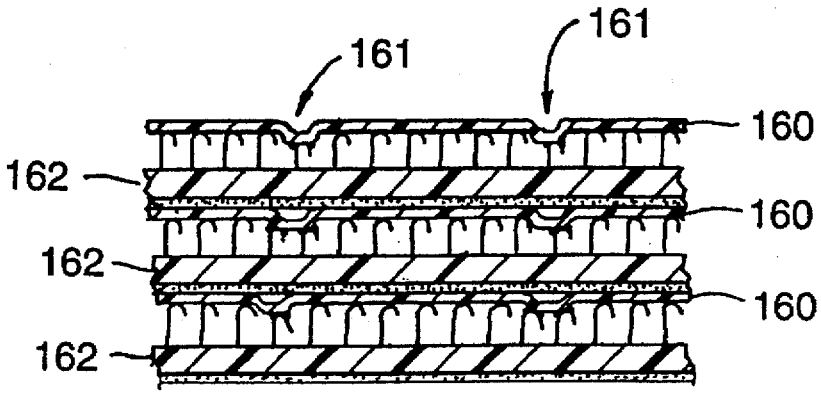
FIG. 11 is a partial sectional view taken across line 11—11 in FIG. 10.

A fastener member was prepared as described above with reference to Example One, with the following exceptions. The dual purpose cover sheet number KR-0261 was replaced by a polypropylene liner having a thickness of 0.127 mm (0.005 in). The polypropylene liner was silicone coated on one side so that it acted as the cover sheet. The non-silicone coated surface was placed face down on the engaging members of the hook fastening member. The hook fastening member was produced using a polypropylene copolymer designated Shell 7C55H, available from Shell Chemical Company, Houston, Tex. The non-silicone side of the cover sheet was then ultrasonically bonded to the hook fastening members using a sonic horn with the circular pattern shown in FIG. 10. Although the circular pattern was used other patterns, such as lines adjacent the lateral edges of the cover sheet, may also be used. FIG. 11 illustrates the fusion between the cover sheet and the fastening members wherein the fastening members are deformed and fused to the cover sheet. The ultrasonic bonding unit used was designated Model#8400, available from the Branson Sonic Power Company, Danbury, Conn. The ultrasonic bonding was performed using a pressure of 30 PSI, a weld time of 2 seconds and a hold time of 2 seconds.

After ultrasonic bonding of the cover sheet to the engaging members the cover sheet was bonded well enough so that the pressure sensitive adhesive of a second hook fastening member could be applied on the silicone release surface of the dual purpose cover sheet and then removed without dislodging the cover sheet. The dual purpose cover sheet however could be removed by hand to expose the engaging members of the first hook fastening member. Other fusion or bonding methods wherein heat is generated to melt or fuse the cover sheet to the engaging member, although not tested, are contemplated and intended to be within the scope of the present invention.

EXAMPLE SEVEN

A fastener member was prepared as described above with reference to Example One, with the following exceptions. The dual purpose cover sheet number KR-0261 was replaced by a polypropylene liner having a thickness of 0.127 mm (0.005 in). The polypropylene liner was silicone coated on one side so that it acted as the cover sheet. The non-silicone coated side of the cover sheet was dot coated with 3M Jet-melt® adhesive #3747 (available from Minnesota Mining and Manufacturing Company, St. Paul, Minn.) using a 3M Polygun™ TC Hot Melt Applicator (available from Minnesota Mining and Manufacturing Company). The adhesive was dot coated using the pattern shown in FIG. 12. While the hot melt adhesive was still warm and tacky the cover sheet was placed face down on the engaging members of a hook fastening member of Example 6. When cooled to room temperature the hot melt was not tacky and the cover sheet was engaging to the fastening members. FIG. 13 illustrates the adhesive bond between the fastening members and the cover sheet.

After bonding of the cover sheet to the engaging members the cover sheet was bonded well enough so that the pressure sensitive adhesive of a second hook fastening member could be applied on the silicone release surface of the dual purpose cover sheet and then removed without dislodging the cover sheet. The dual purpose cover sheet however could be removed by hand to expose the engaging members of the first hook fastening member.

The present invention has now been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

Although the present invention has been described with reference to preferred embodiments, workers skilled in the art will recognize that changes may be made in form and detail without departing from the spirit and scope of the invention.

What is claimed is:

1. A fastener arrangement, comprising:

a first fastener member including a base sheet having a first major surface, and a plurality of engaging members adjoining and projecting from the first major surface;

a dual purpose cover sheet having first and second major surfaces, the first major surface including means for releasably affixing said cover sheet to the first fastener member including an adhesive coated on said first major surface of said cover sheet, said adhesive transitioning from a first non-tacky state at a first temperature to a second tacky state at a second, higher temperature to releasably affix said cover sheet to the first fastener member; and a second fastener member overlying said first fastener member, the second fastener member including a base sheet having first and second major surfaces, a multiplicity of engaging members adjoining and projecting from the first major surface; and an adhesive layer disposed on the second major surface of said base sheet, such that said adhesive layer releasably affixes the second fastener member to the second major surface of said cover sheet.

2. The fastener arrangement of claim 1, wherein the cover sheet is releasably affixed to the engaging members of the first fastener member.

3. The fastener arrangement of claim 1, wherein the cover sheet is releasably affixed to the first major surface of the base sheet.

4. The fastener arrangement of claim 1 wherein the adhesive on said cover sheet comprises a plurality of dots coated onto the first major surface.

5. The fastener arrangement of claim 1, wherein said first and second fastener members and said cover sheet are wound on core, and said first and second fastener members are spaced portions of a unitary, longitudinally extending fastener member.

6. The fastener arrangement of claim 1, wherein the adhesive is a pressure sensitive adhesive selected from the group consisting of styrene-butadiene-styrene rubber adhesives, styrene-isoprene-styrene rubber adhesives, and acrylic adhesives.

7. The fastener arrangement of claim 1, wherein the dual purpose cover sheet comprises polypropylene.

8. The fastener arrangement of claim 1, wherein the base sheet comprises fibers selected from a group consisting of woven fibers and knitted fibers.

9. The fastener arrangement of claim 1, wherein the base sheet is formed from an extruded polymer.

10. The fastener arrangement of claim 1, wherein the engaging members of the first fastener member comprise a first structured surface, and the means for releasably affixing said cover sheet to the engaging members comprises a second structured surface adapted for intermeshing engagement with the first structured surface, wherein said structured surfaces of said first fastener member and said cover sheet each including a plurality of solid tapered elements, each element having at least one side inclined relative to a common plane in each of said first fastener member and said cover sheet at an angle sufficient to form a taper so that said element of said first fastener member may mesh with said elements of said cover sheet when brought into contact with one another and said cover sheet may be releasably affixed to said first fastener member at least partially because of the frictional force of adherence of said contacting sides of said elements of said first fastener member and said elements of said cover sheet and wherein the tangent of the half angle of the tapered sides of the element is no greater than the coefficient of friction of the material of the contacting surfaces.

11. The fastener arrangement of claim 1, wherein the dual purpose cover sheet comprises a web having a layer of pressure sensitive adhesive on one major surface thereof, whereby the pressure sensitive adhesive layer affixes the cover sheet to the engaging members.

12. The fastener arrangement of claim 1, wherein one major surface of the dual purpose cover sheet includes means for facilitating release of the adhesive layer of the second fastener member.

13. A fastener arrangement, comprising:

a first fastener member including a base sheet having a first major surface, and a plurality of engaging members adjoining and projecting from the first major surface;

a dual purpose cover sheet having first and second major surfaces, the first major surface including means for releasably affixing said cover sheet to the first fastener member including a mechanical interlock directly between said base sheet and said cover sheet; and a second fastener member overlying said first fastener member, the second fastener member including a base sheet having first and second major surfaces, a multiplicity of engaging members adjoining and projecting from the first major surface; and an adhesive layer disposed on the second major surface of said base sheet, such that said adhesive layer releasably affixes the second fastener member to the second major surface of said cover sheet.

14. A fastener arrangement, comprising:

a first fastener member including a base sheet having a first major surface, and a plurality of engaging members adjoining and projecting from the first major surface;

a dual purpose cover sheet having first and second major surfaces, the first major surface including means for releasably fusing said first major surface of said cover sheet to the first fastener member; and a second fastener member overlying said first fastener member, the second fastener member including a base sheet having first and second major surfaces, a multiplicity of engaging members adjoining and projecting from the first major surface; and an adhesive layer disposed on the second major surface of said base sheet, such that said adhesive layer releasably affixes the second fastener member to the second major surface of said cover sheet.

15. A fastener arrangement, comprising:

a first fastener member including a base sheet having a first major surface, and a plurality of engaging members adjoining and projecting from the first major surface;

a dual purpose cover sheet having first and second major surfaces, the first major surface including means for releasably affixing said cover sheet to the first fastener member including a pressure sensitive adhesive coated on said first major surface of said cover sheet for releasably adhered at least a portion of the first major surface of the cover sheet directly to at least a portion of said base sheet; and a second fastener member overlying said first fastener member, the second fastener member including a base sheet having first and second major surfaces, a multiplicity of engaging members adjoining and projecting from the first major surface; and an adhesive layer disposed on the second major surface of said base sheet, such that said adhesive layer releasably affixes the second fastener member to the second major surface of said cover sheet.

16. The fastener arrangement of claim 1, wherein the second fastener member is affixed to the second major surface of the cover sheet with a separation force that is less than the affixation force at which the first major surface of the cover sheet is releasably affixed to at least one of the base sheet and engaging elements of the first fastener, so that when the second fastener is removed from the fastener arrangement, the dual purpose cover sheet remains affixed to the first fastener member.

17. A fastener arrangement, comprising:

a first fastener member including a base sheet having a first major surface, and a plurality of engaging members adjoining and projecting from the first major surface;

a dual purpose cover sheet having first and second major surfaces, the first major surface including means for releasably affixing at least a portion of said cover sheet directly to at least a portion of said base sheet; and a second fastener member overlying said first fastener member, the second fastener member including a base sheet having first and second major surfaces, a multiplicity of engaging members adjoining and projecting from the first major surface, and an adhesive layer disposed on the second major surface of said base sheet, such that said adhesive layer releasably affixes the second fastener member directly to the second major surface of said cover sheet.

18. The fastener arrangement of claim 1, wherein said adhesive layer releasably adheres the second fastener member directly to the second major surface of said cover sheet.

19. A fastener arrangement, comprising:

a first fastener member including a base sheet having a first major surface, and a plurality of engaging members adjoining and projecting from the first major surface;

a dual purpose cover sheet having first and second major surfaces, the first major surface including means for releasably affixing said cover sheet directly to at least a portion of the base sheet and the engaging members of the first fastener member, wherein said releasable affixing means includes a discontinuous coating of adhesive on said first major surface of said cover sheet; and a second fastener member overlying said first fastener member, the second fastener member including a base sheet having first and second major surfaces, a multiplicity of engaging members adjoining and projecting from the first major surface, and an adhesive layer disposed on the second major surface of said base sheet, such that said adhesive layer releasably affixes the second fastener member to the second major surface of said cover sheet.

20. The fastener arrangement of claim 19, wherein said discontinuous coating of adhesive includes a plurality of dots of adhesives.

21. The fastener arrangement of claim 19, wherein said discontinuous coating of adhesive on said first major surface of said cover sheet transitions from a first, non-tacky state at a first temperature to a second, tacky state at a second, higher temperature when coated, to releasably affix said cover sheet to the first fastener member.

* * * * *

UNITED STATES PATENT AND TRADEMARK OFFICE

CERTIFICATE OF CORRECTION

'ATENT NO.: 5,691,026

)ATED: November 25, 1997

\VENTOR(S): Bradley D. Zinke, Timothy N. Narum, Marvin D. Lindseth, and Carey J. Eckhardt t is certified that error appears in the above-identified patent and that said Letters Patent is hereby :orrected as shown below:

:tem [75],

Jnder the heading "Inventors" please add the following people:

--Marvin D. Lindseth and Carey J. Eckhardt--

Signed and Sealed this

Nineteenth Day of May, 1998

Bruce Lehman

*Attest:*

BRUCE LEHMAN

*Attesting Officer*

*Commissioner of Patents and Trademarks*